US009909272B2

(12) United States Patent
Lancelot et al.

(10) Patent No.: US 9,909,272 B2
(45) Date of Patent: Mar. 6, 2018

(54) CRASH GUARD

(76) Inventors: Robert L Lancelot, Las Vegas, NV (US); Guillermina Damian-Lancelot, Las Vegas, NV (US)

( * ) Notice: Subject to any disclaimer, the term of this patent is extended or adjusted under 35 U.S.C. 154(b) by 0 days.

(21) Appl. No.: 12/535,925

(22) Filed: Aug. 5, 2009

(65) Prior Publication Data

US 2017/0254034 A1 Sep. 7, 2017

Related U.S. Application Data

(60) Provisional application No. 61/089,988, filed on Aug. 19, 2008.

(51) Int. Cl.
*E01F 15/14* (2006.01)
*E04H 1/12* (2006.01)
*E01F 15/00* (2006.01)

(52) U.S. Cl.
CPC ..... *E01F 15/14* (2013.01); *E01F 15/003* (2013.01); *E01F 15/146* (2013.01); *E04H 1/1211* (2013.01)

(58) Field of Classification Search
CPC ..... E01F 15/003; E01F 15/10; E01F 15/14; E01F 15/143; E01F 15/146; E01F 15/148; E04H 1/1205; E04H 1/1211
USPC ..... 256/1, 13.1
See application file for complete search history.

(56) References Cited

U.S. PATENT DOCUMENTS 4,685,656 A * 8/1987 Lee ..... E01F 15/025 256/13.1
5,186,438 A * 2/1993 Cross ..... E01F 7/04 256/12.5
6,581,616 B1 * 6/2003 Venegas, Jr. ..... A47F 10/04 135/121

FOREIGN PATENT DOCUMENTS

DE 9208144 U1 * 9/1992 ..... E04H 1/1205
DE 10202364 A1 * 6/2003 ..... E04H 1/1211
EP 0523804 A1 * 1/1993 ..... E04H 1/1205

* cited by examiner

*Primary Examiner* — Josh Skroupa
(74) *Attorney, Agent, or Firm* — FisherBroyles, LLP; Rob L. Phillips

(57) ABSTRACT

A crash guard configured to resist intrusion of a vehicle from a traffic lane into an area and to resist intrusion into an area of debris caused by an impact of a vehicle into the crash guard or into another vehicle.

13 Claims, 7 Drawing Sheets

CRASH GUARD

FIELD OF THE DISCLOSURE

This invention relates to crash guards to provide protection against out-of-control vehicles and debris.

BACKGROUND

The purpose of the present invention is to provide protection against out-of control vehicles for people congregating near moving vehicles. Typical locations where the invention would be useful include bus stops and outdoor dining areas situated near roadways or parking lots. Although outdoor dining areas have existed for some time, the advent of indoor smoking prohibitions have caused many bars, restaurants and like establishments to establish or expand outdoor dining areas. Due to property constraints many of these outdoor dining areas have been placed adjacent to roadways or parking lots where vehicle traffic is prevalent.

Likewise, both for convenience and land constraints bus stops are typically placed adjacent to roadways where vehicular traffic occurs. It is very common that sidewalks are often poured right up to the curb, leaving scant feet between traffic and pedestrians to begin with. Bus stops and the accompanying benches and waiting areas, are often anchored to the sidewalk just a few feet from the curb. Some communities recognizing the danger have passed legislation allowing public easements that oftentimes allow shelters to be placed behind the sidewalk. Although of some benefit, these measures at best place a few additional feet between the waiting people and an out-of-control vehicle. Some communities have attempted to locate bus stops behind utility poles that could act as barriers. Other communities have installed or considered installing bollards—concrete posts—around the bus shelters. Using utility poles of course is subject to a utility pole being conveniently located and relies largely on luck that an out-of-control vehicle would come from a direction and in a manner such that it would hit the pole rather than the people at the bus stop. At best, the use of utility poles would provide protection only in some accidents. The inventors recognized that an additional problem with respect to utility poles, concrete bollards and other methods is that although a vehicle hitting such barriers may be stopped, the impact oftentimes allows for portions of the vehicle to intrude into the area to be protected by the bollards or utility poles and/or sends pieces of the concrete bollards, the utility pole or the vehicle and fluids from the vehicle into the people the barrier is meant to protect.

The present invention addresses these needs and many objects and advantages derived from the present invention will become apparent to those skilled in the art from this specification. Although the above background has emphasized the invention's use with respect to outdoor dining areas and bus stops, the invention is certainly not limited to the uses or locations described. Rather, the invention could be used wherever protection of people near moving vehicles is desired.

SUMMARY OF THE INVENTION

Disclosed herein is a crash guard to resist intrusion of a vehicle from a traffic lane into an area and to resist intrusion into that area of debris caused by an impact of a vehicle into the crash guard or into another vehicle. The traffic lane could be any area where moving vehicles are present and need not be a traditional traffic lane. It could, for example, be a parking lot or similar area. The crash guard includes two or more front bollards anchored into the ground between the traffic lane and the area to be protected. The front bollards define at least one perimeter of the area and are of sufficient construction and sufficiently anchored to the ground so as to resist the intrusion of vehicles across the perimeter into the area to be protected. There is at least one guard rail designed to resist intrusion across the perimeter attached between the bollards. A vertical debris shield is attached above the front bollards and extending along the vertical plane of the perimeter. There may also be a debris shield attached between the front bollards.

The crash guard may also include two or more rear bollards which define a second perimeter of the area to be protected. Roof decking support beams may extend vertically from the rear bollards and roof decking may be attached to the roof decking support beams and extend over the area to be protected. The roof decking may be attached to the front of the crash guard or may simple cantilever from the roof decking support beams and extend over the crash guard. Alternatively, a portion of the roof decking, preferably a portion over the front of the area to be protected, may instead be of canopy debris shields. These embodiments may also include a debris shield between the front bollards.

The crash guard may also be connected to an existing structure either by attaching the canopy debris shields or roof decking to the existing structure. For example, a crash guard could include front bollards, a guard rail and vertical debris screens and either roof decking or canopy debris shields attached or adjacent to the roof structure of an existing bus stop shelter or other structure.

BRIEF DESCRIPTION OF THE DRAWINGS

These and other features and advantages will become appreciated as the same becomes understood with reference to the description, claims and drawings wherein:

DESCRIPTION

Figure 1:
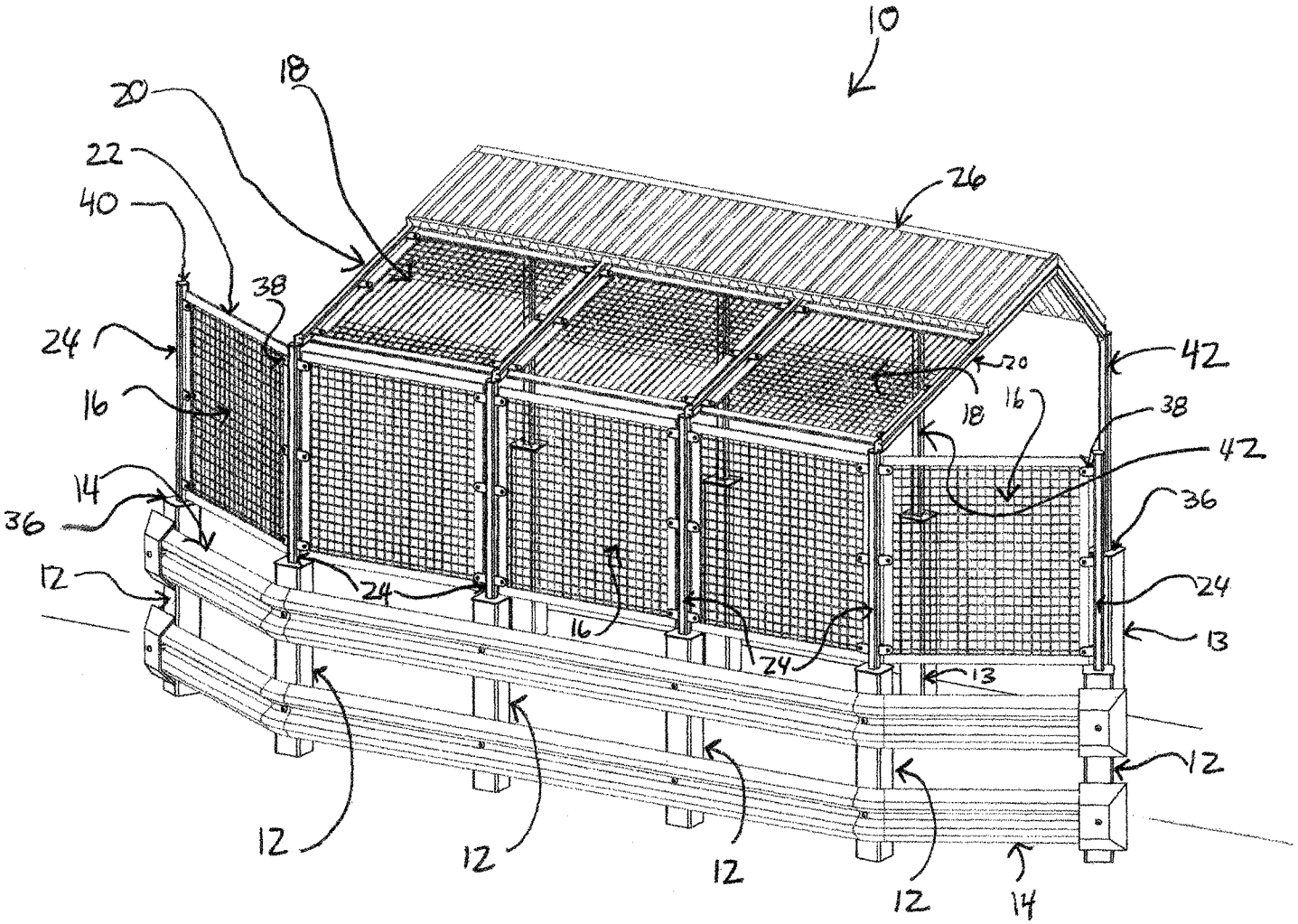
FIG. 1 is an exterior front perspective view of one embodiment of the invention.
Figure 2:
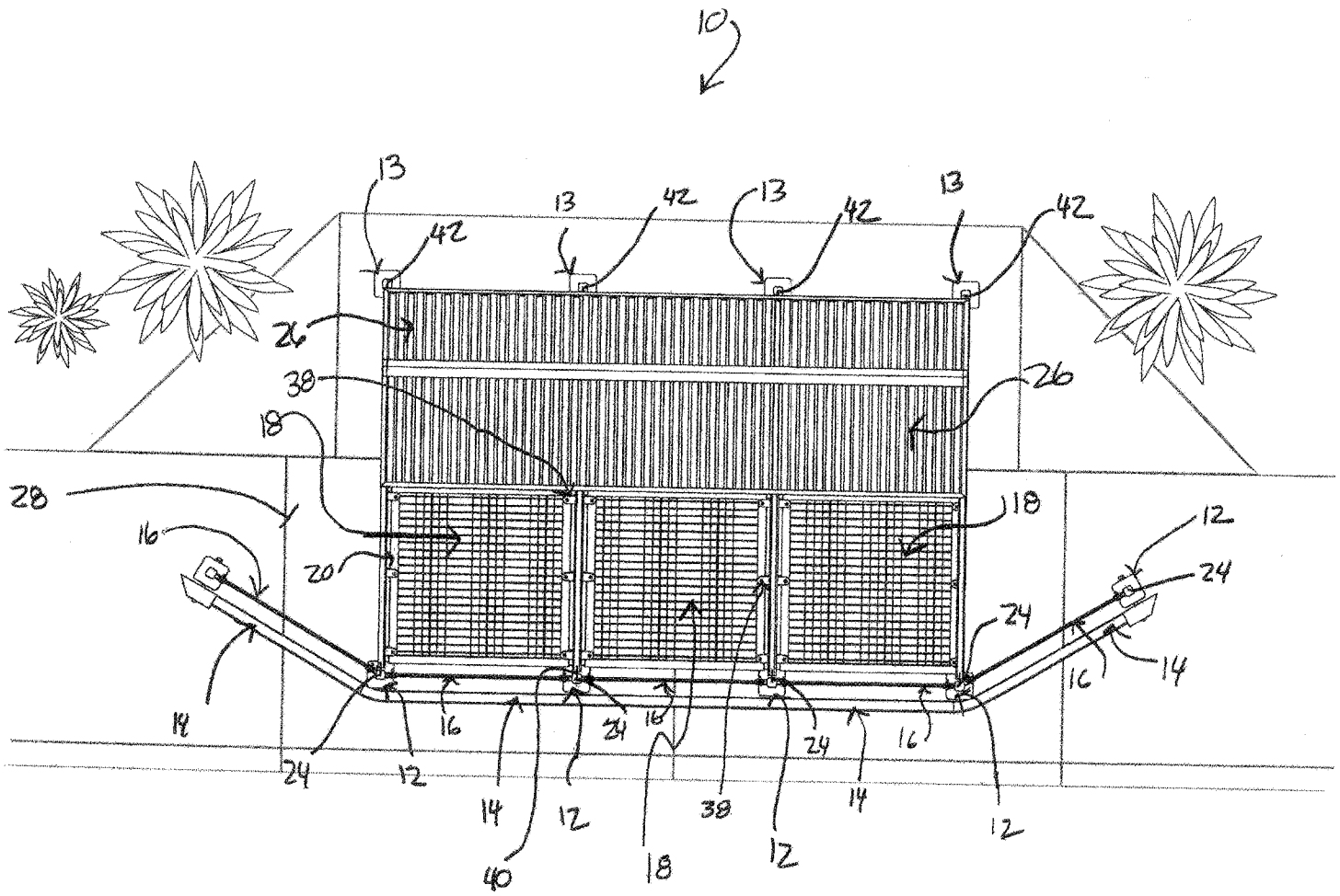
FIG. 2 is a top plan view of one embodiment of the invention.
Figure 3:
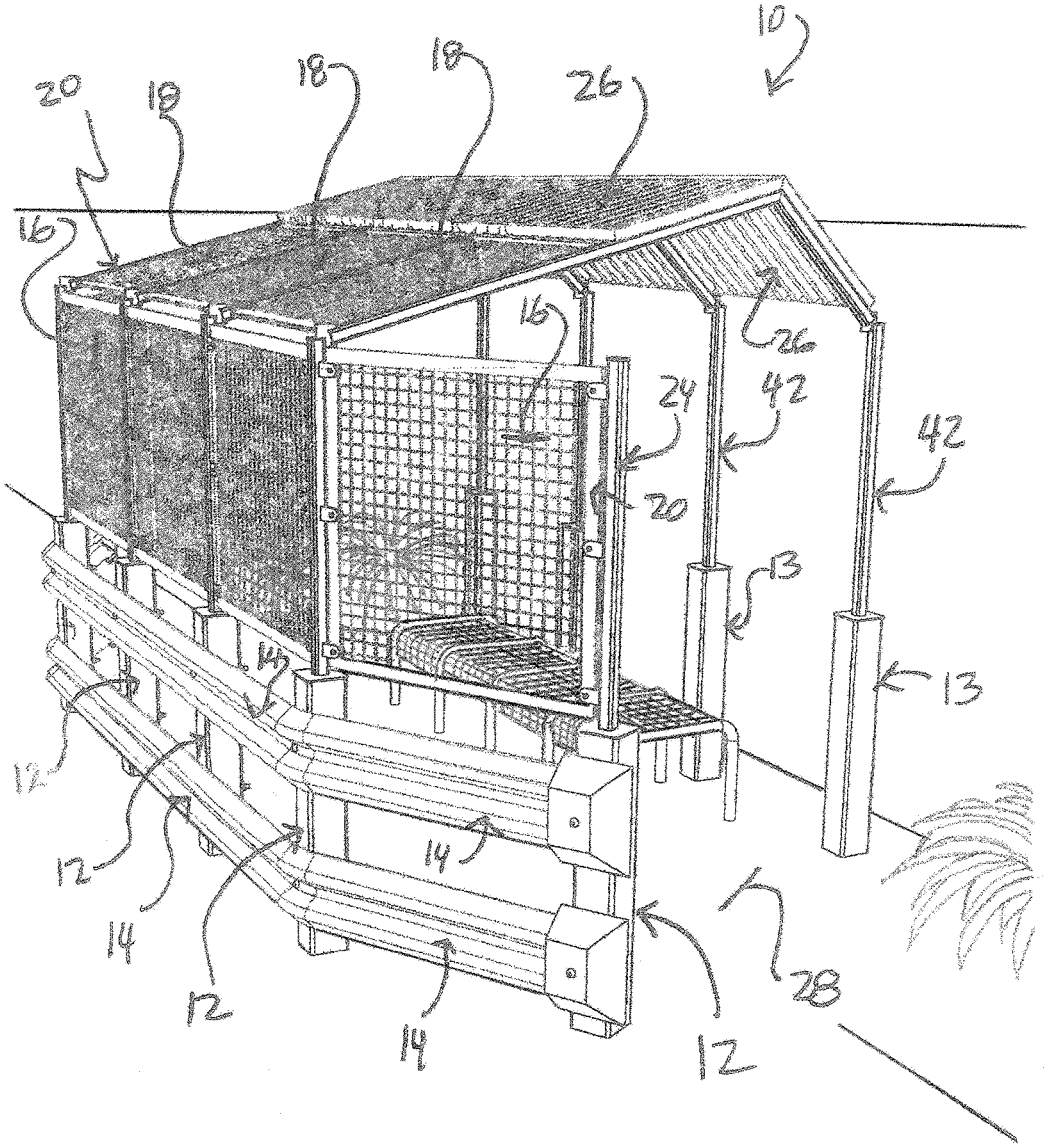
FIG. 3 is an exterior side perspective view of one embodiment of the invention.
Figure 4:
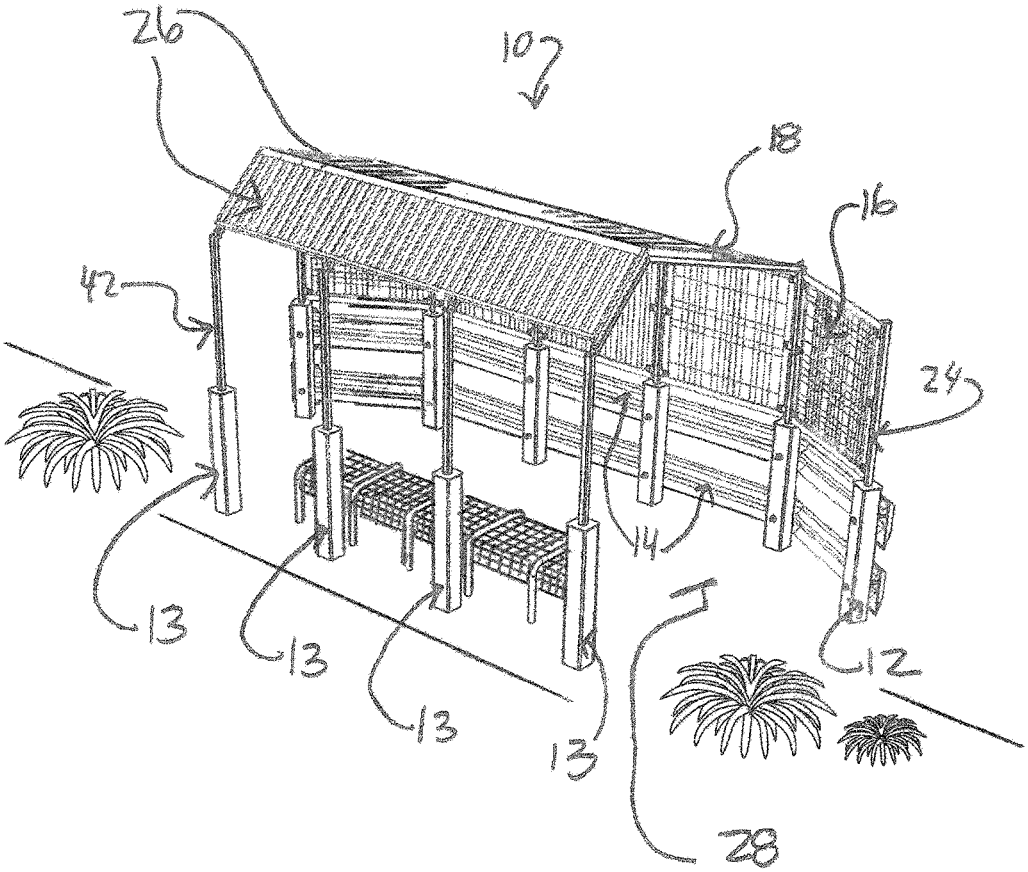
FIG. 4 is an exterior rear perspective view of one embodiment of the invention.

Turning to FIGS. 1-4, there is shown a first embodiment of a bus stop crash guard of the invention generally designated by reference number 10. In this embodiment, an interior space is defined by a crash guard 10 the components of which include front bollards 12, rear bollards 13, guard rails 14, debris shields 16, canopy debris shields 18 and roof decking 26 all connected via various framework components as described in more detail below. As best seen in FIGS. 3 and 4, the crash guard 10 may define thresholds 28 on either side of the crash guard 10 through which ingress and egress may be made. The crash guard components and the framework components of the crash guard 10 may be made of a variety of materials so long as adequate crash and debris protection is provided. In one embodiment shown in FIGS. 1-5, the materials and construction are as follows.

Figure 5:
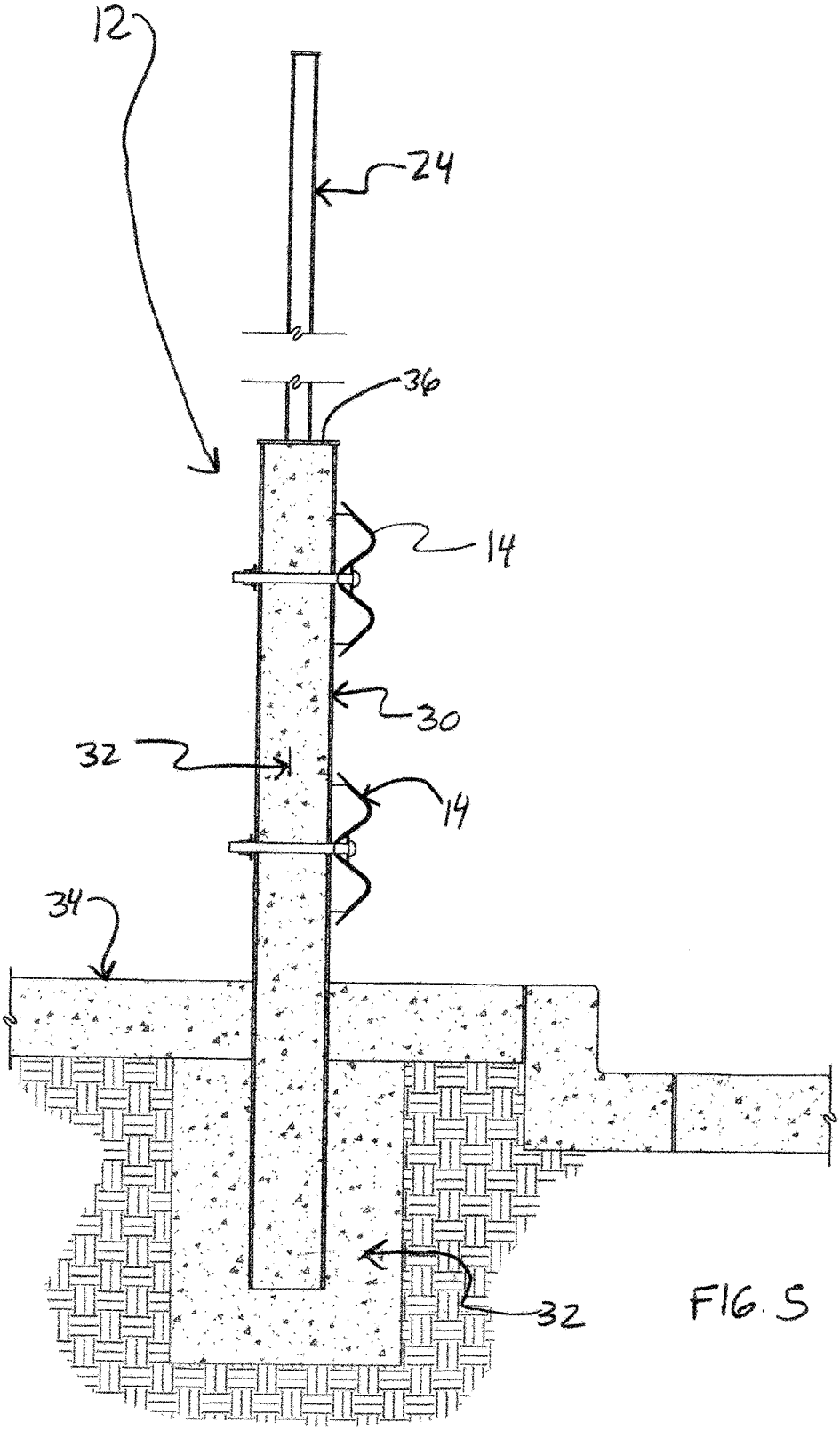
FIG. 5 is a side view of one aspect of the invention.

As seen in FIG. 5, the bollards 12 are preferably made of steel tubes 30 filled with concrete 32. The bollards 12 are approximately three feet six and one-quarter inches high above the ground and are sunk approximately six feet into concrete foundations 32 below the sidewalk 34 or other area upon which the crash guard 10 may be located. Steel plate end caps 36 are attached to the top of each bollard and galvanized steel debris shield supports 24 are attached to the steel plate end caps 36. In this embodiment, the steel tubes 30 are constructed of galvanized steel TS6"×6"×¼" and filled with 2500 psi concrete. The guardrails 14 are TOGA galvanized, for example Grainger #1CWR3. There are preferably two guardrails 14 placed on the front of the crash guard 10 with the center of the lower guardrail approximately ten and one-half inches above grade and the center of the upper guardrail approximately one foot nine inches above the center of the lower guardrail. The end caps 36 on the bollards 12 may be made of ¼" steel plate. In the embodiment just described, the bollards 12 are designed for a 10,000-pound maximum horizontal point load located at two feet eight inches above grade. The rear bollards 13 may be constructed similarly to the front bollards 12 but it may not be necessary if crash protection is not needed or needed minimally from the rear side of the crash guard 10. If no protection or only minimal protection is needed, the rear bollards 13 need only be strong enough to structurally support the roof decking support beams 42 and the roof decking 26. Depending on local codes, ordinances and the like and/or the degree of intrusion protection desired with respect to a particular location, the bollards 12, 13 and the guardrails 14 may be of different materials, construction and installation than as just described above with respect to this particular embodiment. For example, embodiments could include only one guardrail or three or more guard rails. The guard rails need not be of galvanized steel but could be of sufficiently strong rubber, plastic or composite or otherwise constructed to meet the varying codes, ordinances, regulations or building practices of various locales in which the crash guard 10 may be deployed. Likewise, the bollards could be constructed entirely of concrete or other materials or may have different combinations of steel and concrete than as specified above.

Continuing with FIGS. 1 through 4, the debris shields 16 are attached to the debris shield supports 24 by flat bar tabs 38 and via weld to a flat bar frame 22. The flat bar frame is also welded to the debris shield supports 24. The canopy debris shields 18 are attached to the debris shield supports 24 by blade brackets 40 and to the truss frame 20 by flat bar tabs 38. The roof decking 26 is attached to the crash guard 10 via the truss frame 20 and the roof decking support beams 42. The roof decking support beams 42 are inserted into the rear bollards 13.

In the embodiment shown, the debris shield supports 24 are galvanized steel such as TS2"×2"×3/16". The truss frame 20 is 2"×2" steel. The flat bar frames 22 are 2"×⅛" steel. In the embodiment shown, the debris shields 16 and the canopy debris shields 18 are made of metal wire mesh screen such as a square opening wire mesh plain steel square weave with an opening size of approximately two inches and ¼-inch wire diameter. The roof decking 26 is made of metal. The debris shields are attached to the debris shield supports 24 via ⅛" steel flat bar tabs 38 with ⅜" bolts or other suitably strong attachment methods or devices. The canopy screens 18 are attached to the truss frame 20 via ⅛" steel flat bar tabs 38 with ⅜" bolts or other suitably strong attachment methods or devices and to the screen supports 24 via ¼" steel blade brackets 40 or other suitably strong attachment methods or devices. The canopy screens may also be made of a wire mesh screen similar to that of the debris shields. Both, the debris shields and canopy screens may be made of other sufficiently strong materials including wire mesh made of materials other than steel or solid materials such as metal plate, plexiglass, rubber, plastics, etc.

The method and means of attachment of the various components of the crash guard 10 shown in FIGS. 1 through 5 and described above is just one such method of attaching the various components. Other methods of attachment and materials as is known in the trade of engineering, architecture, building and construction could be used without departing from the basic operating principles and concepts of this disclosure.

It can also be seen that alternative embodiments are available depending on the degree of protection needed, local site factors and cost. If additional protection is desired from debris intruding into the interior space by passing between the bollards 12 or the guardrails 14, additional debris shields 16 may be attached either to the bollards 12 or to the guardrails 14. In some crash scenarios it is possible that debris could be thrown over the debris shields. Accordingly, the embodiment shown in FIGS. 1-4 includes canopy debris shields 18. However, if protection from debris intruding into the interior space defined by the crash guard by going over the debris shields 16 is not desired or deemed to be of minimal risk, the crash guard 10 need not include the canopy debris shields 18. Alternatively, if additional protection from very small debris or liquid debris is desired the debris shields 16, whether attached to the debris shield supports 20, to the bollards 12 or to the guardrails 14 may instead of being constructed of wire mesh may be constructed of a suitably strong solid material such as steel plate, plexi-glass, or like materials that provide the desired degree of protection from intrusion of small debris and liquids. Likewise, various combinations of different types of debris shields 16 and canopy screens 18 may be used depending on the risks for which protection is sought. Thus, the debris shields attached to the bollards 12 or guardrails 14 could be of a solid material to protect against a greater likelihood of liquid debris that may occur at the point of impact with the crash guard 10 while the debris shields 18 attached to the debris shield supports 24 may be of a mesh or screen type material to protect against solid debris only. Likewise the canopy debris shields 18 may be of solid material to provide additional protection from the weather or the less likely liquid debris from the point of impact or may be of a lighter screen or mesh material to protect only from the relatively smaller sized debris that would be thrown up from the point of impact to that height. In another embodiment, there may be no canopy debris shields 18 but the roof decking 26 could nonetheless extend from the rear decking support beams 42 across the entire structure to overhang in front of the debris shields 16 and the debris shield supports 24. In such an embodiment the roof could be either entirely constructed of canopy debris shields 18 or, preferably, solid roof decking 26 to protect against weather and debris. The roof could also include or be comprised of photovoltaic (solar) panels and the crash guard could include equipment to store power to power lights, advertising and the like that are associated with the crash guard or the bus stop or other area, businesses, etc. that the crash guard protects. The crash guard may also include equipment to connect the crash guard to an existing power grid either to take power from the grid to power lights, advertising, etc., or to feed/sell power back to the grid or some combination thereof.

Figure 6:
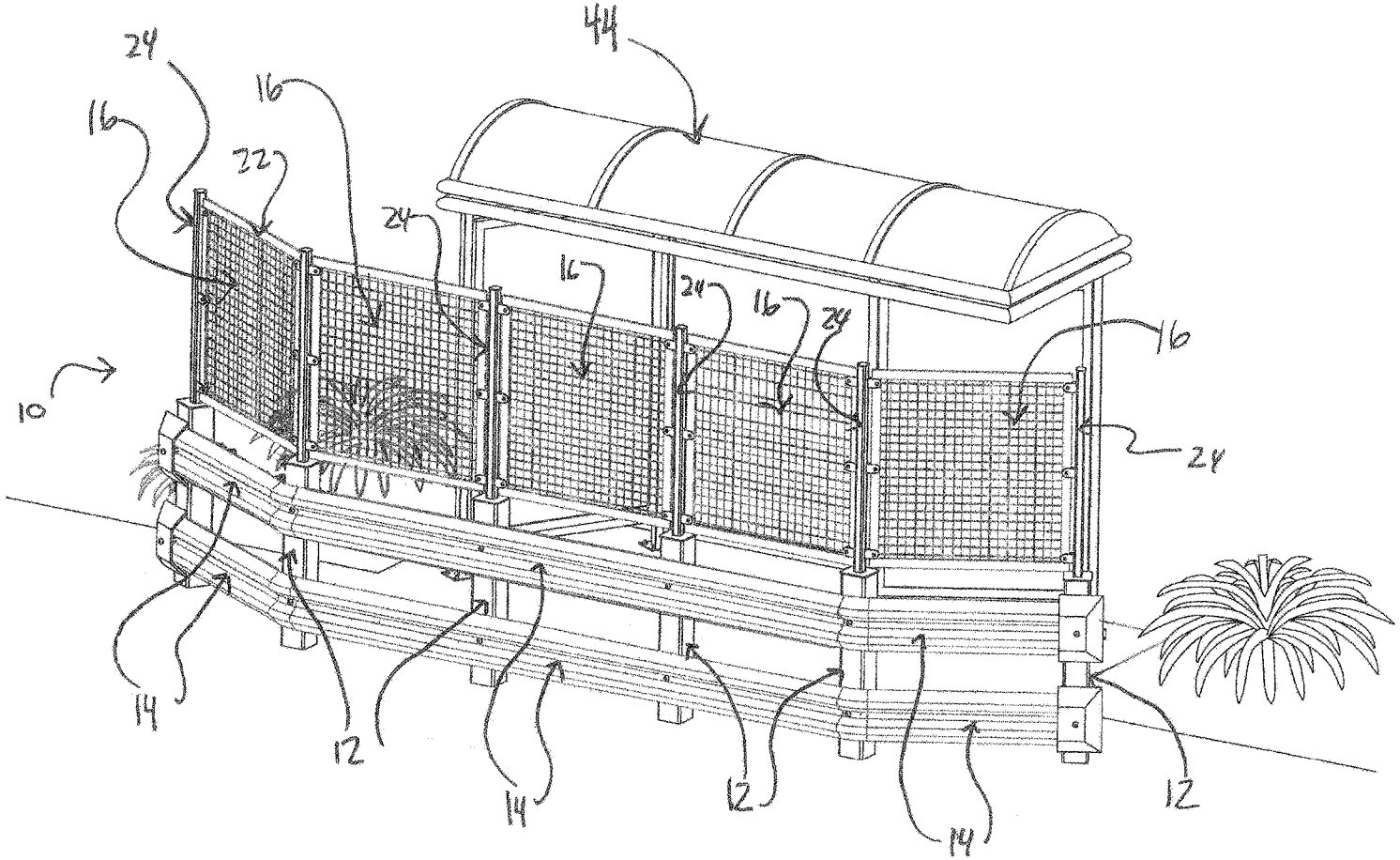
FIG. 6 is an exterior front perspective view of another embodiment of the invention.
Figure 7:
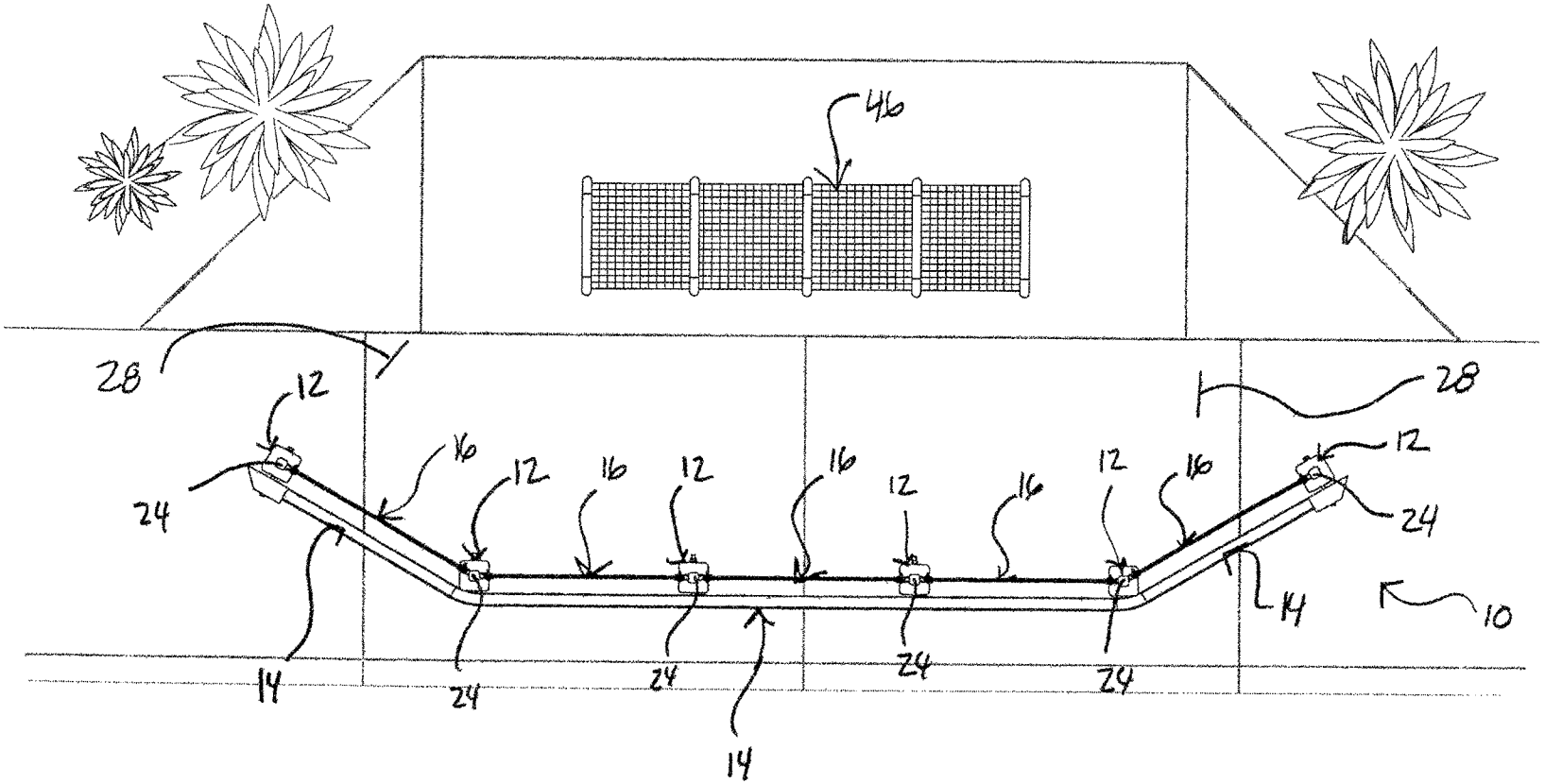
FIG. 7 is a top plan view of another embodiment of the invention.

Yet other embodiments may depend on local site factors. For example, FIG. 6 shows an embodiment that could be used where the local site already has an existing bus stop shelter 44 and FIG. 7 shows an embodiment where the local site already has an existing bench 46. In these embodiments shown in FIGS. 6 and 7, the components of the crash guard 10 include front bollards 12, guardrails 14, debris shield supports 24, and debris shields 22. In the embodiment shown in FIG. 6, the crash guard could optionally include canopy debris shields 18 attached to the existing shelter 44.

While I have shown and described certain embodiments of the present invention, it should be understood that the same is subject to many modifications and changes by those skilled in the art without departing from the basic concepts and operating principles of the disclosure.

What is claimed is:

1. A crash guard to resist intrusion of a motorized vehicle from a traffic lane into an area and to resist intrusion into said area of debris caused by an impact of said motorized vehicle into said crash guard, said crash guard comprising:

two or more front bollards anchored into the ground between said traffic lane and said area, said front bollards defining at least one perimeter of said area and being constructed and anchored to the ground so as to resist the intrusion of motorized vehicles across said perimeter into said area;

at least one guard rail, the first end of said guard rail attached to a first front bollard and the second end of said guard rail attached to a second front bollard, said guard rail resisting intrusion across said perimeter; and at least one vertical debris shield attached above said front bollards, said vertical debris shield extending along a vertical plane of said perimeter.

2. The crash guard of claim 1 further comprising:

at least one debris shield attached between two of said front bollards.

3. The crash guard of claim 1 further comprising:

two or more rear bollards defining a second perimeter of said area;

roof decking support beams extending vertically from said rear bollards; and roof decking extending over said area.

4. The crash guard of claim 3 further comprising:

at least one debris shield between two of said front bollards.

5. The crash guard of claim 1 further comprising:

two or more rear bollards defining a second perimeter of said area;

roof decking support beams extending vertically from said rear bollards;

roof decking extending over a rear portion of said area; and canopy debris shields extending over a front portion of said area.

6. The crash guard of claim 5 further comprising:

at least one debris shield between two of said front bollards.

7. The crash guard of claim 1 further comprising:

canopy debris shields extending over said area, said canopy debris shields being attached to an existing structure.

8. The crash guard of claim 1 further comprising:

roof decking extending over said area, said roof decking being attached to an existing structure.

9. A rest area structure proximate to a street for motorized vehicles comprising:

two or more front bollards anchored into the ground between said street and said rest area, said front bollards supporting a lower horizontal guard rail and an upper horizontal guard rail, said two or more front bollards defining at least one perimeter of said rest area and being constructed and anchored to the ground so as to resist the intrusion of motorized vehicles across said perimeter into said rest area; and at least one vertical debris shield attached above said two or more front bollards, said vertical debris shield extending along a vertical plane of said perimeter.

10. The crash guard of claim 9 further comprising:

two or more rear bollards defining a second perimeter of said area;

roof decking support beams extending vertically from said rear bollards; and roof decking extending over said area.

11. The crash guard of claim 9 further comprising:

two or more rear bollards defining a second perimeter of said area;

roof decking support beams extending vertically from said rear bollards;

roof decking extending over a rear portion of said area; and canopy debris shields extending over a front portion of said area.

12. The crash guard of claim 9 further comprising:

canopy debris shields extending over said area, said canopy debris shields being attached to an existing structure.

13. The crash guard of claim 9 further comprising:

roof decking extending over said area, said roof decking being attached to an existing structure.

* * * * *